US007414509B2

(12) United States Patent
Yagi et al.

(10) Patent No.: US 7,414,509 B2
(45) Date of Patent: Aug. 19, 2008

(54) MINIATURE SURFACE-MOUNT ELECTRONIC COMPONENT AND METHOD FOR MANUFACTURING THE SAME

(75) Inventors: Masayoshi Yagi, Sakado (JP); Shingo Shimizu, Saitama-ken (JP); Shin Murakami, Tsurugashima (JP)

(73) Assignee: Toko Inc., Ota-Ku, Tokyo-To (JP)

( * ) Notice: Subject to any disclaimer, the term of this patent is extended or adjusted under 35 U.S.C. 154(b) by 0 days.

(21) Appl. No.: 11/804,755

(22) Filed: May 18, 2007

(65) Prior Publication Data

US 2007/0268102 A1 Nov. 22, 2007

(30) Foreign Application Priority Data

May 19, 2006 (JP) ..... 2006-140193

(51) Int. Cl.
*H01F 5/00* (2006.01)

(52) U.S. Cl. ..... 336/200

(58) Field of Classification Search ..... 336/65, 336/83, 200, 206, 208, 220–222, 192, 232
See application file for complete search history.

(56) References Cited

U.S. PATENT DOCUMENTS 6,144,280 A * 11/2000 Amada et al. ..... 336/192
6,157,283 A * 12/2000 Tsunemi ..... 336/192
6,344,784 B1 * 2/2002 Murata et al. ..... 336/83
7,312,682 B2 * 12/2007 Yasuda et al. ..... 336/200

FOREIGN PATENT DOCUMENTS

JP 02043708 A * 2/1990
JP 10092670 A * 4/1998

* cited by examiner

*Primary Examiner*—Tuyen T. Nguyen
(74) *Attorney, Agent, or Firm*—Renner, Kenner, Grieve, Bobak, Taylor & Weber

(57) ABSTRACT

A miniature surface-mount electronic component which can ensure sufficient impact resistance and vibration resistance especially in an application to a severe use environment such as a vehicle-mounted coil, by putting some contrivance into a method for fixing a coil in a molding process and a method for holding a core and terminals. A miniature surface-mount electronic component including a bar-shaped core 2 on which a winding wire 3 is wound, and metal plates 5, with an outer casing 7 made of an insulating resin molded, includes flanges 2*b* substantially quadrangular in section at both ends of the bar-shaped core 2, and vertical grooves a and b are provided on side surfaces of the flanges 2*b* of the bar-shaped core 2 as fixing portions for preventing positional displacement occurring when the outer casing 7 is molded.

3 Claims, 3 Drawing Sheets

MINIATURE SURFACE-MOUNT ELECTRONIC COMPONENT AND METHOD FOR MANUFACTURING THE SAME

CROSS REFERENCE TO RELATED APPLICATIONS

This application is based upon and claims the benefit of priority from the prior Japanese Patent Application No. 2006-140193, filed on May 19, 2006, the entire contents of which are incorporated herein by reference.

BACKGROUND OF THE INVENTION

1. Field of the Invention

The present invention relates to a miniature surface-mount electronic component in which a coil wound on a ferrite core is resin-molded. A miniature surface-mount electronic component according to the present invention includes an antenna applicable to a vehicle-mounted transponder or the like, an inductor for a communication device, a choke coil or the like.

2. Related Art

Various types of miniature surface-mount electronic components have been conventionally proposed, and have been in practical use. As one of them, a miniature surface-mount electronic component applicable as a vehicle-mounted antenna or a transponder has been proposed recently. In miniature surface-mount electronic components applied to such a use, cores made of ferrite favorable in high-frequency characteristic are generally used. The configuration in which a coil wound on the core by the required number of windings, and an outer periphery of the core including the winding wire with the winding wire terminals of the coil connected to metal terminals provided at both ends in a longitudinal direction of the core are molded of an insulating resin is adopted.

In order to satisfy the required characteristics such as an inductance value, a Q value and self-resonance frequency characteristics required of this kind of coil, a core slim and longer in a winding axis direction of the coil is generally used as a core.

However, the core is a brittle sintered body, and is originally weak against impact and vibrations as earthenware. In addition, for the above described reason, the core tends to be weak against impact and vibrations, and cannot help being formed into a slim and long shape. Therefore, in the case of the vehicle-mounted coil which is always exposed to impact and vibrations, it is important how to realize the structure excellent in impact resistance and vibration resistance.

From such a point of view, for example, Japanese Patent Laid-Open No. 7-130556 discloses a coil which is entirely covered with resin molding.

Japanese Patent Laid-Open No. 2003-31803 discloses the coil improved in impact resistance and vibration resistance by covering the entire body with an insulating resin, and putting some contrivance into the shape of a core, the terminal structure and the like.

However, in these coils, core breakage due to the terminal holding structure of the core becomes a problem. There exist the problems of core breakage occurring because positional displacement or the like of the coil occurs in the molding process of coating the entire body with an insulating resin and the terminals are fixed, and wire breakage occurring because fixation of the terminals and the core becomes loose and the winding terminals are pulled.

The present invention is made in view of the above described problems, and has an object to provide a miniature surface-mount electronic component which can ensure sufficient impact resistance and vibration resistance especially in an application to a severe use environment such as a vehicle-mounted coil, by putting some contrivance into a method for fixing a coil in a molding process and a method for holding a core and terminals.

SUMMARY OF THE INVENTION

In order to solve the above-described problems, the present application provides the following invention.

A miniature surface-mount electronic component set forth in claim 1 is a miniature surface-mount electronic component including a bar-shaped core on which a winding wire is wound, metal plate terminals to which the winding wire is connected, and an outer casing made of an insulating resin, containing the bar-shaped core therein and exposing the metal plate terminals to an outside, characterized in that the bar-shaped core includes flanges provided at both ends of the bar-shaped core, and vertical grooves which are substantially quadrangular in section, are provided on both side surfaces facing in opposite directions of the flanges of the bar-shaped core, and are for preventing positional displacement occurring when the outer casing is molded.

Further, a miniature surface-mount electronic component set forth in claim 2 is, in the miniature surface-mount electronic component set forth in claim 1, characterized in that the metal plate terminal has a metal plate, and a base made of an insulating resin and having a pair of pillars, and the metal plate terminal and the bar-shaped core are fixed to each other by fitting the pair of pillars to the vertical grooves.

Further, a miniature surface-mount electronic component set forth in claim 3 is, in the miniature surface-mount electronic component set forth in claim 2, characterized in that the metal plate is formed from one metal plate, is bent in a U-shape in a longitudinal direction, and projection portions to which the terminal of the winding wire is connected are extensively provided at both side surfaces of one bent portion.

A method for manufacturing a miniature surface-mount electronic component set forth in claim 4 is a method for manufacturing a miniature surface-mount electronic component including a bar-shaped core on which a winding wire is wound, metal plate terminals to which the winding wire is connected, and an outer casing made of an insulating resin, containing the bar-shaped core therein and exposing the metal plate terminals to an outside, characterized by including the steps of:

preparing the bar-shaped core having flanges at both ends, and having vertical grooves on any one of side surfaces or both the side surfaces of the flanges, fixing the metal plate terminals to the bar-shaped core, winding the winding wire on the bar-shaped core, and electrically connecting terminals of the winding wire to the metal plate terminals, preparing a molding mold in which projections for fixing the bar-shaped core are raised at positions abutting on the vertical grooves of the bar-shaped core, and molding an outer casing made of an insulating resin for the bar-shaped core and the metal plate terminals by using the molding mold.

As described above, according to the present invention, by providing the vertical grooves on both side surfaces facing in opposite directions of the flanges of the bar-shaped core, and molding the outer casing with the projections (pins) for fixing raised in the mold for molding the outer casing, positional displacement occurring when the outer casing is molded can be prevented. In the metal plate terminals, by fixing the metal plate to the base made of the insulating resin, and fitting and fixing a pair of pillar portions provided at the base to the vertical grooves of the bar-shaped core, the bar-shaped core and the metal plate terminal are firmly fixed, and peeling off of the metal plate terminals, wire breakage of the winding wire terminals and the like due to vibrations and impact can be prevented at the time of molding the outer casing, and in the sate in which it is mounted on the mounting board. Especially in the application to the severe use environment such as a vehicle-mounted coil, sufficient impact resistance and vibration resistance can be ensured.

DETAILED DESCRIPTION OF THE INVENTION

Figure 1:
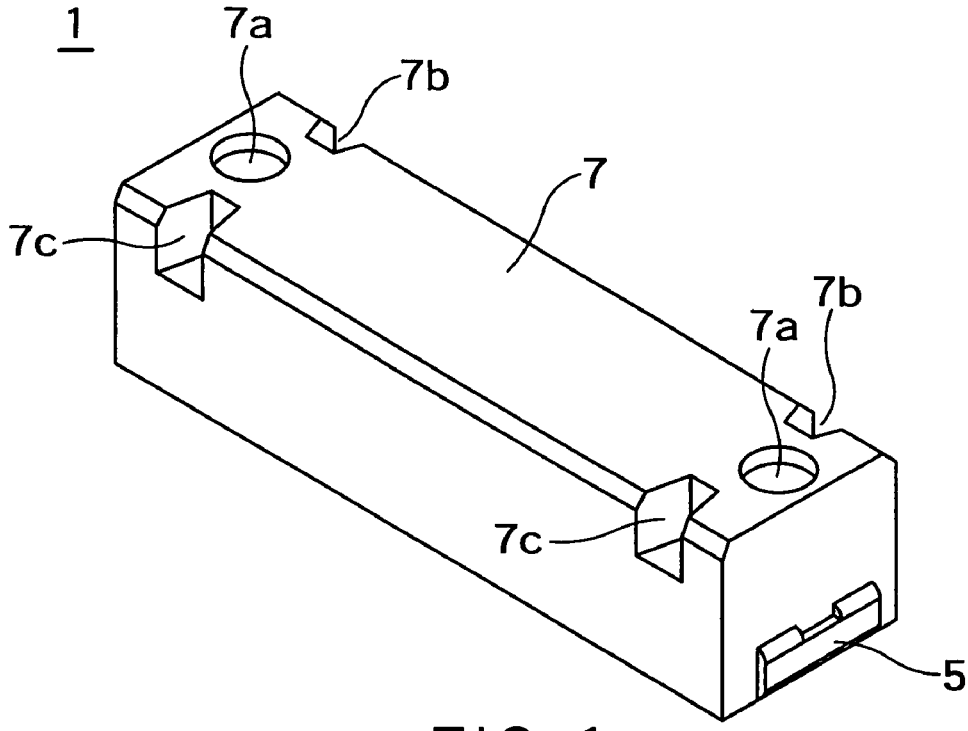
FIG. 1 is a perspective view showing an entire shape of a miniature surface-mount electronic component according to the present invention.
Figure 2:
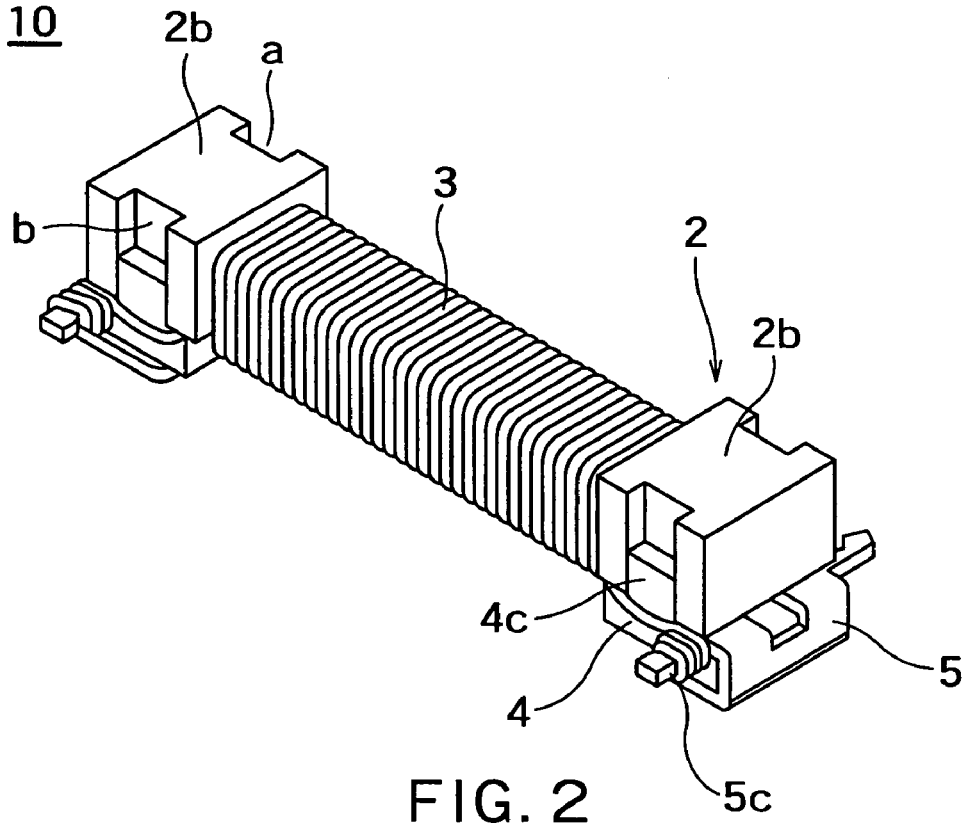
FIG. 2 is a perspective view showing the shape of a coil wounded on a bar-shaped core used for the miniature surface-mount electronic component according to the present invention.

FIG. 1 is an external perspective view showing one embodiment of a miniature surface-mount electronic component according to the present invention. FIG. 2 is a perspective view of a coil which is an internal configuration of the miniature surface-mount electronic component shown in FIG. 1, and FIGS. 3(*a*) to 3(*c*) are exploded perspective views of a core and a terminal which is the internal configuration of the miniature surface-mount electronic component shown in FIGS. 1 and 2. FIG. 4 shows a front sectional view of the miniature surface-mount electronic component. The miniature surface-mount electronic component is applied to an antenna, a vehicle-mounted antenna, a transponder, a choke coil, an inductor of an electronic device and the like.

As shown in FIGS. 1 to 4, a miniature surface-mount electronic component 1 includes a core 2 in the shape of a bar long in a longitudinal direction, a winding wire 3, a base 4, a metal plate 5 and an outer casing 7 made of an insulating resin.

The core 2 is a bar-shaped core slim and long in the longitudinal direction having a winding part 2*a*, and has flange parts 2*b* and 2*b* substantially quadrangular in section at both ends of the core 2. The core 2 is a ferrite core, and its material is selected in accordance with the required characteristic. The ferrite core can be obtained from a sintered body of ferrite powder, mechanical work of a ferrite bar, or combination of both of them.

The winding part 2*a* of the core 2 has the shape slim and long in the longitudinal direction. In the embodiment shown in the drawings, its section is quadrangular, but any sectional shapes may be adopted such as a polygonal shape, a circular shape, and an oval shape, which are the other sectional shapes.

In the flange parts 2*b* and 2*b* of the core 2, vertical grooves a and b are formed along both side surfaces parallel in a winding axis direction from a top surface to a bottom surface. The vertical grooves a and b are for preventing positional displacement in resin molding of the outer casing, and are portions which abut on projections (pins) provided in a mold to fix the core.

Figure 3:
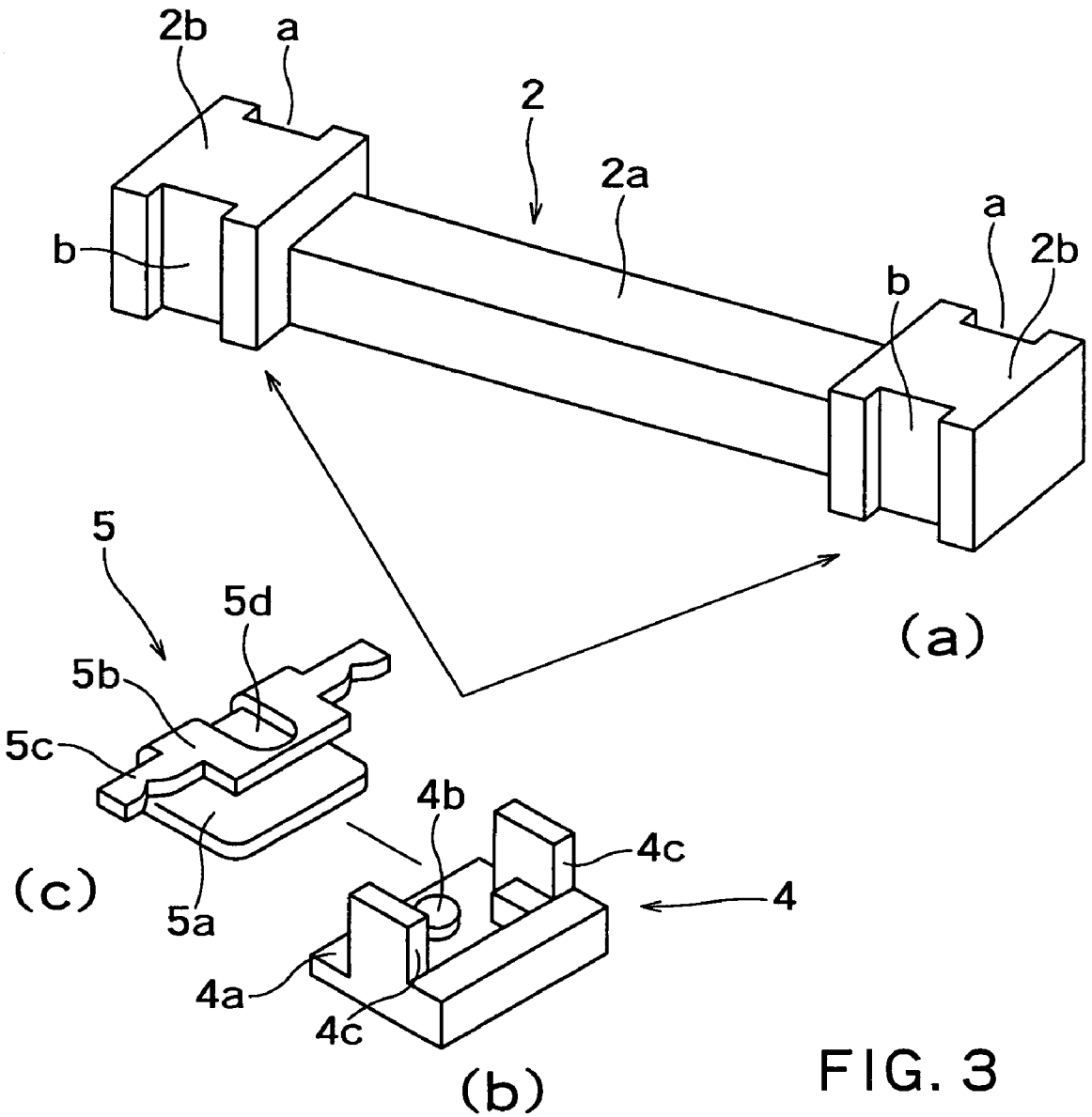
FIGS. 3(*a*) to 3(*c*) are perspective views of the bar-shaped core shown in FIG. 2 (FIG. 3(*a*)), a perspective view of a base (FIG. 3(*b*)), and a perspective view of a metal plate (FIG. 3(*c*))
Figure 4:
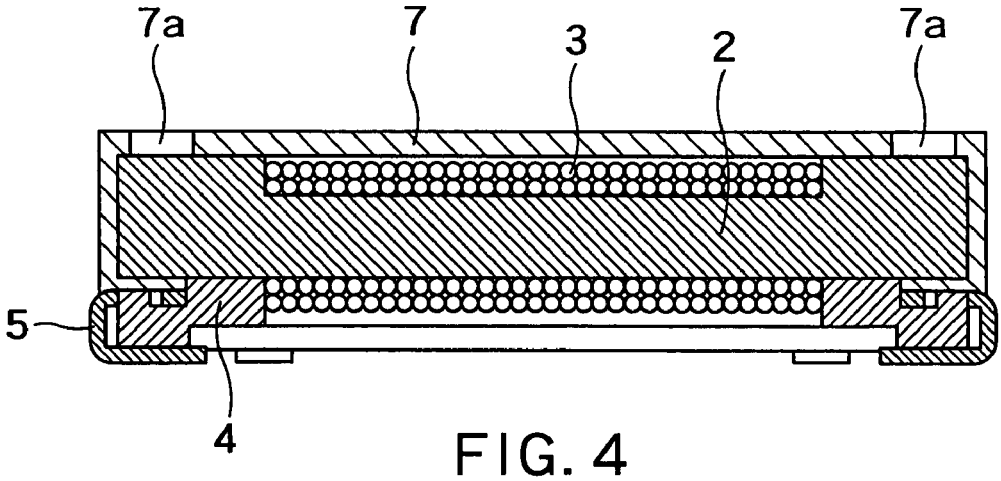
FIG. 4 is a sectional view of the miniature surface-mount electronic component shown in FIG. 1.

A metal plate terminal which electrically connects to a winding wire terminal and an outside is constituted of the base 4 made of an insulating resin, and the metal plate 5 (see FIGS. 3(*b*) and 3(*c*)).

The metal plate 5 is a metal plate bent into a U-shape in the longitudinal direction, and a bottom surface 5*a* becomes an external terminal suitable for surface-mounting. A bent top surface 5*b* is provided with connecting terminals 5*c* for a winding wire terminal, which are extensively provided respectively at both side surfaces. In a central portion, a notch 5*d* is provided from a bottom surface to the top surface. As the material of the metal plate terminal 5, a nonmagnetic material such as, for example, phosphor bronze is suitable.

The base 4 is for firmly fixing the metal plate 5 and the flange part 2*b* of the core 2. A projection 4*b* is formed on a top surface of a bottom surface portion 4*a* provided in the base 4. The notch 5*d* of the metal plate 5 is fitted onto the projection 4*b* and the metal plate 5 is assembled. Pillars 4*c* raised upward are provided on both side surfaces of the bottom surface portion 4*a*.

The pillars 4*c* and 4*c* are fitted in the vertical grooves a and b so as to sandwich the vertical grooves a and b provided on the flange 2*b* of the core 2, and are firmly fixed with an adhesive or the like. The width and thickness of each of the pillars 4*c* and 4*c* of the base 4, and each of the vertical grooves a and b provided on the flange 2*b* of the core 2 are set at substantially the same dimensions. The height of each of the pillars 4*a* and 4*b* of the base 4 is set at substantially ½ of the thickness of the core.

The winding wire 3 is wound on the winding part 2*a* of the core 2. The number of windings and the wire diameter of the winding wire 3 differ depending on the miniature surface-mount electronic component to be obtained. The terminal of the winding wire 3 is fastened to any one of the terminal connecting portions 5C of the metal plate 5, and electrically connected to it by soldering, welding or the like.

The winding wire 3 is wound on the core 2 to which the metal plates 5 assembled to the bases 4 are fixed by being fitted in the flange portions 2*b* of the core, and the winding wire terminals are electrically connected to the connection terminals 5*c* of the metal plates 5, whereby the coil 10 being the miniature surface-mount electronic component is formed.

Figure 5:
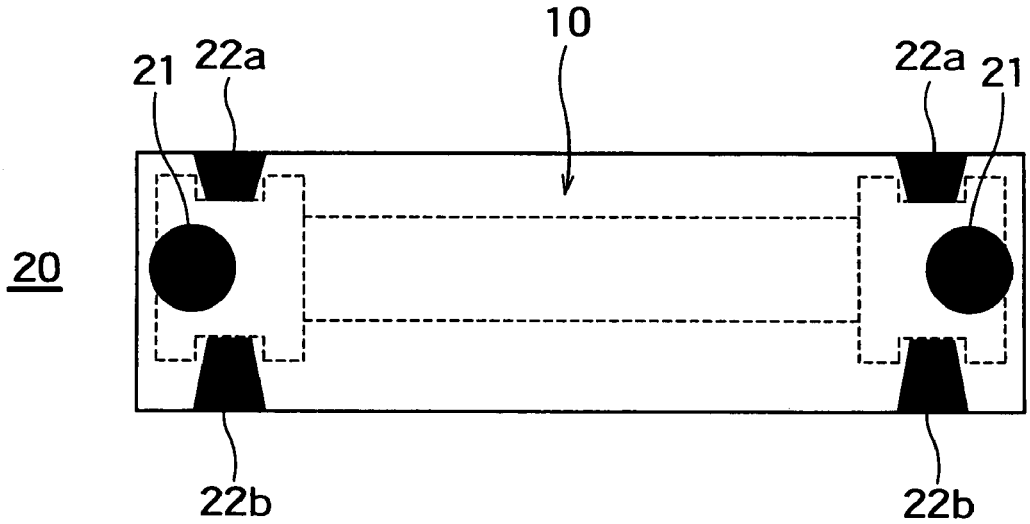
FIG. 5 is a schematic view showing the inside of a mold for molding a top surface of the miniature surface-mount electronic component shown in FIG. 1.

FIG. 5 shows the inside of the mold for molding the top surface of the miniature surface-mount electronic component which is the characteristic of the present invention. The outer casing 7 made of the insulating resin covers the core outer periphery including the winding part by using a mold 20 shown in FIG. 5.

A part of the bottom surface 5*a* of the metal plate is used for connection to an external circuit, and is not covered with the outer casing. The mold for the bottom surface of the miniature surface-mount electronic component is omitted in the drawings.

As shown in FIG. 5, in the mold 20, projections (pins) 21 abutting on the surfaces of both the flange parts 2*b* and 2*b* of the core 2, and (side surface) projections (pins) 22*a* and 22*b* abutting on the vertical grooves a and b provided on both the flange parts 2*b* and 2*b* of the core 2 are provided inside.

Figure 6:
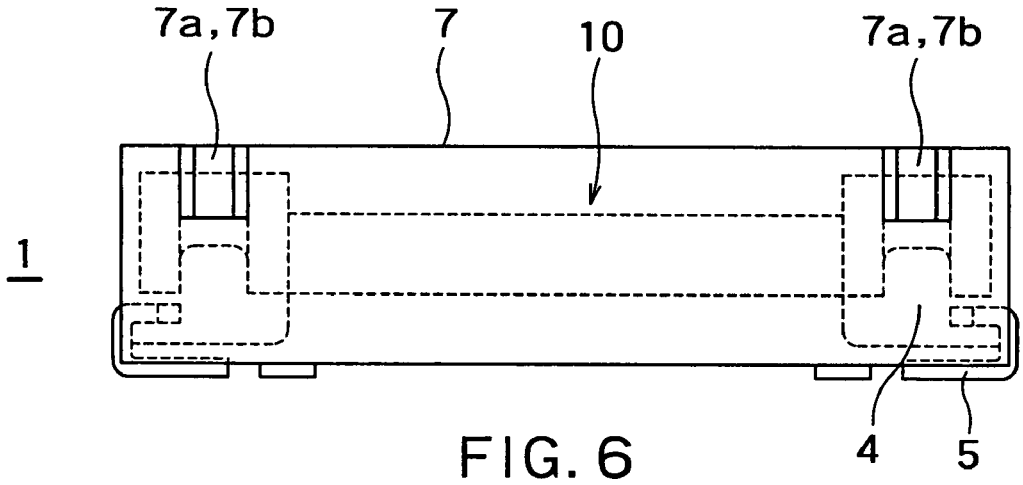
FIG. 6 is a schematic explanatory view explaining the positional relationship of an outer casing and the coil of the miniature surface-mount electronic component according to the present invention.

FIG. 6 shows the positional relationship of the coil 10 and positions of the projections (22*a*, 22*b*) of the mold 20 and the pillars 4*c* of the bases. In this manner, the metal plate terminals (bases) are firmly fixed and positional displacement which becomes important at the time of molding the outer casing can be prevented by using the vertical grooves provided on the flanges of the core.

In this case, projections (pins) abutting on the side surfaces of the molding mold are provided at four spots in the embodiment, but the projections may be provided at two spots (22*a* and 22*a*, or 22*b* and 22*b*) by providing the projections at the gate positions in consideration of the flow of the resin injection.

Reference numeral and character 7*a* shown in the perspective view of FIG. 1 is a recessed portion formed with the projection 21, and reference numerals and characters 7*b* and 7*c* are recessed portions formed with the projections 22*a* and 22*b* of the mold.

Next, a method for manufacturing the miniature surface-mount electronic component will be described.

(1) Step of fixing the metal plate terminals to the bar-shaped core

As shown in FIG. 3(*a*) to 3(*c*), the projection portion 4*b* of the base 4 and the notched portion 5*d* of the metal plate 5 are fitted to each other, the bottom surface portion 4*a* of the base 4 is put into the bent portion of the metal plate 5, and the adhesive is coated on the projection portion 4*b* of the base 4 and the notched portion 5*d* of the metal plate 5 to bond and fix them firmly. Then, the pillars 4*c* and 4*c* provided at the base 4 are fitted to the vertical grooves a and b provided on the flange part 2*b* of the bar-shaped core 2 to sandwich them from the bottom surface, and are firmly fixed to them with an adhesive or the like.

(2) Step of winding the winding wire on the bar-shaped core and electrically connecting the terminals of the winding wire to the metal plate terminals As shown in FIG. 2, the winding wire 3 is wound on the winding part 2*a* (FIG. 3(*a*)) of the bar-shaped core 2 by using an insulating coated wire, and the winding wire terminals are electrically connected to one connecting terminal 5*c* of the metal plate 5 provided each of the flange parts 2*b* by soldering, welding or the like.

(3) Step of molding the outer casing made of the insulating resin

As shown in FIG. 5, molding is performed by using the upper mold in which the projections (pins) 22*a* and 22*b* for fixing the core are raised at the positions abutting on the vertical grooves a and b provided on each of the flange parts 2*b* of the bar-shaped core 2.

Here, in the above described embodiment, the projections (pins) abutting on the side surfaces of the molding mold are provided at the four spots (22*a*, 22*a*, 22*b*, 22*b*), but they may be provided at two spots (22*a*, 22*a* or 22*b*, 22*b*) by providing them at the gate positions in consideration of the flow of the resin injection.

The embodiment of the miniature surface-mount electronic component and the method for manufacturing the same of the present invention are described thus far, but the present invention is not limited to the embodiment. Those skilled in the art can obviously adopt various modifications.

What is claimed is:

1. A miniature surface-mount electronic component comprising a bar-shaped core on which a winding wire is wound, metal plate terminals to which said winding wire is connected, and an outer casing made of an insulating resin, containing said bar-shaped core therein and exposing said metal plate terminals to an outside, wherein said bar-shaped core comprises flanges provided at both ends of said bar-shaped core, and vertical grooves which are substantially quadrangular in section, are provided on both side surfaces facing in opposite directions of said flanges of said bar-shaped core, and are for preventing positional displacement occurring when the outer casing is molded.

2. The miniature surface-mount electronic component according to claim 1, wherein said metal plate terminal has a metal plate, and a base made of an insulating resin and having a pair of pillars, and said metal plate terminal and said bar-shaped core are fixed to each other by fitting said pair of pillars in said vertical grooves.

3. The miniature surface-mount electronic component according to claim 2, wherein said metal plate is formed from one metal plate, is bent in a U-shape in a longitudinal direction, and projection portions to which the terminal of said winding wire is connected are extensively provided at both side surfaces of one bent portion.

* * * * *